US006309253B1

(12) United States Patent
Tsai

(10) Patent No.: US 6,309,253 B1
(45) Date of Patent: Oct. 30, 2001

(54) DISTRIBUTOR FOR THE STEREOS OF MOTOR VEHICLE

(75) Inventor: Liao-Tai Tsai, Taipei (TW)

(73) Assignee: Real Power Cap Company, Taipei (TW)

( * ) Notice: Subject to any disclaimer, the term of this patent is extended or adjusted under 35 U.S.C. 154(b) by 0 days.

(21) Appl. No.: 09/626,423

(22) Filed: Jul. 26, 2000

(51) Int. Cl.[7] ..... H01R 13/68
(52) U.S. Cl. ..... 439/621; 439/76.2
(58) Field of Search ..... 439/621, 622, 439/830, 831, 832, 833, 76.2, 34, 362, 365, 402, 405, 949; 179/52.1; 361/794, 790, 792–793; 174/72 B, 70 B

(56) References Cited

U.S. PATENT DOCUMENTS 4,685,753 * 8/1987 Isshiki et al. ..... 439/74
4,834,664 * 5/1989 Lin ..... 439/145
5,144,530 * 9/1992 Cohen et al. ..... 361/378
5,731,944 * 3/1998 Yasukuni et al. ..... 361/104
5,915,978 * 6/1999 Hayakawa et al. ..... 439/76.2
6,050,856 * 4/2000 Suguira ..... 439/621
6,162,097 * 12/2000 Liang ..... 439/621

* cited by examiner

*Primary Examiner*—Paula Bradley
*Assistant Examiner*—Alexander Gilman
(74) *Attorney, Agent, or Firm*—Birch, Stewart, Kolasch & Birch, LLP

(57) ABSTRACT

A distributor for the stereos of motor vehicle is provided wherein a recess is formed on divider for receiving negative input terminal block, a groove is formed adjacent recess for receiving positive input terminal block, and a riser is formed between positive input terminal block and negative input terminal block for insulating positive input terminal block from negative input terminal block. The invention is compact and convenient in installation.

18 Claims, 4 Drawing Sheets

DISTRIBUTOR FOR THE STEREOS OF MOTOR VEHICLE

BACKGROUND OF THE INVENTION

1. Field of Invention

The present invention relates to a distributor of motor vehicle having the characteristics of being compact.

2. Related Art

Conventionally, power supplied by battery of a motor vehicle is distributed to the electrical devices such as stereo, head light, etc. by a distributor as illustrated in FIGS. 1A and 1B. In detail, distributor consists of a fuse block (FIG. 1A) and a negative current distributing member (FIG. 1B), which are separated. Fuse block comprises a base, a plurality of positive input terminals (e.g., four as shown) on one end of the base, a plurality of parallel positive output terminals (e.g., four as shown) on the other opposed end of the base, a plurality of slots (e.g., four as shown) and sockets (e.g., one as shown) on the positive input terminal, a plurality of pairs (e.g., four pairs as shown) of slot and socket each provided on the positive output terminal, a plurality of fuses each connected between the corresponding slots of the positive input terminal and the positive output terminal, and a cover enclosed above components for preventing dust and foreign objects from entering the distributor.

Negative current distributing member comprises a base, a metal member on the base, a plurality of negative input terminals on one end of the metal member, a plurality of negative output terminals on the other opposed end of the metal member, and a cover enclosed above components.

But this is unsatisfactory for the purpose for which the invention is concerned for the following reason. It is known that distributor is typically provided in the nacelle under the hood. It is required to open the hood prior to mounting the fuse block and the negative current distributing member. This is quite inconvenient in installing. Further, the installation of the separated fuse block and the negative current distributing member may occupy the already crowded space in the nacelle, thus leaving insufficient space for accommodating associated components of engine, alternator, etc. In addition, two molds are required to manufacture the separated fuse block and negative current distributing member respectively, resulting in an increase in the manufacturing cost.

Thus, it is desirable to provide an improved distributor in order to overcome the above drawbacks of prior art.

SUMMARY OF THE INVENTION

It is an object of the present invention to provide a distributor having a fuse block and a negative current distributing member formed together, thereby significantly reducing the volume of distributor.

The advantages of the present invention are realized by providing a distributor comprising a fuse block, a negative current distributing member, a divider, and a housing member for receiving above components.

Housing member comprises a plurality of positive input terminal slots and a plurality of negative input terminal slots on the pivot side, and a plurality of positive output terminal slots and a plurality of negative output terminal slots on the other end opposed to the pivot side. The main purpose of housing member is preventing dust and foreign objects from entering the distributor. Fuse block comprises a positive input terminal block and a plurality of positive output terminals. Negative current distributing member comprises a negative input terminal block, a plurality of negative output terminals, and a metal plate (e.g., made of copper). The metal plate is integrally formed with (or clung to) negative output terminal block on one end and integrally formed with (or clung to) distributor terminals of negative output terminals on the other end. The negative output terminals are received in a plurality of troughs that are formed by divider and metal plate. Divider has a recess for receiving negative input terminal block and a groove near the recess for receiving positive input terminal block. A riser is formed between positive input terminal block and negative input terminal block for insulating positive input terminal block from negative input terminal block as well as reducing storage space of blocks. A plurality of fuses that is provided on the spaces on slots of the divider is connected between positive output terminals and positive input terminals.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1A:
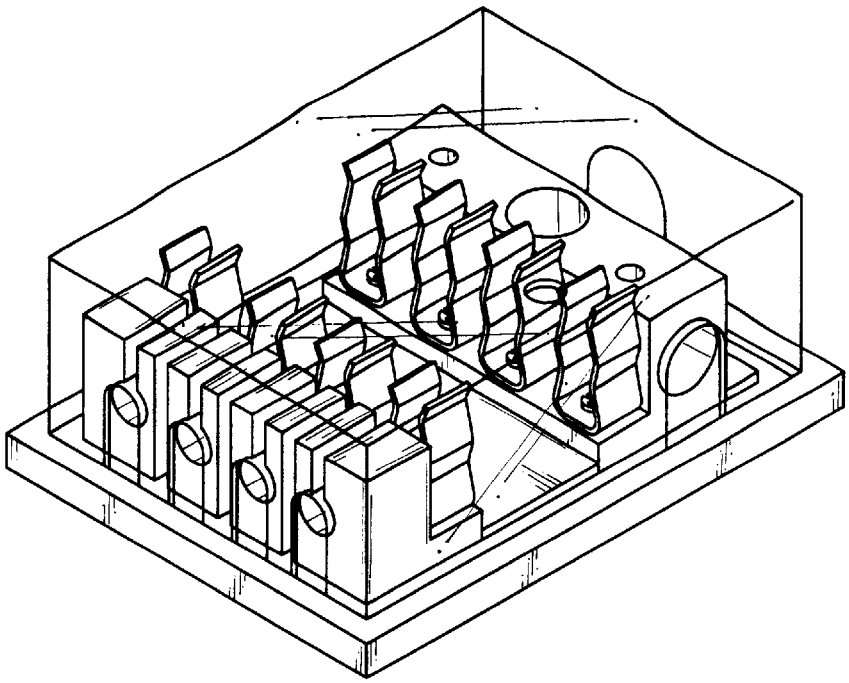
FIG. 1A (PRIOR ART)
FIG. 1A is a perspective view of fuse block of a conventional distributor of motor vehicle.
Figure 1B:
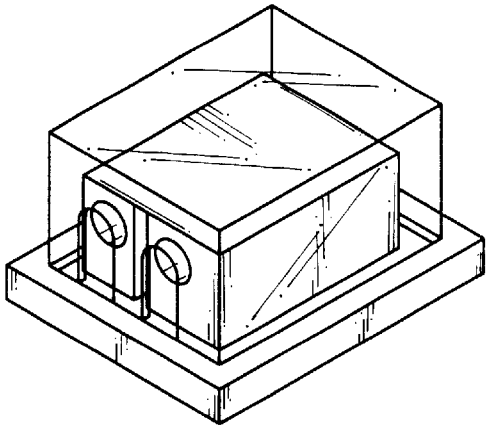
FIG. 1B (PRIOR ART)
FIG. 1B is a perspective view of negative current distributing member of a conventional distributor of motor vehicle.
Figure 2:
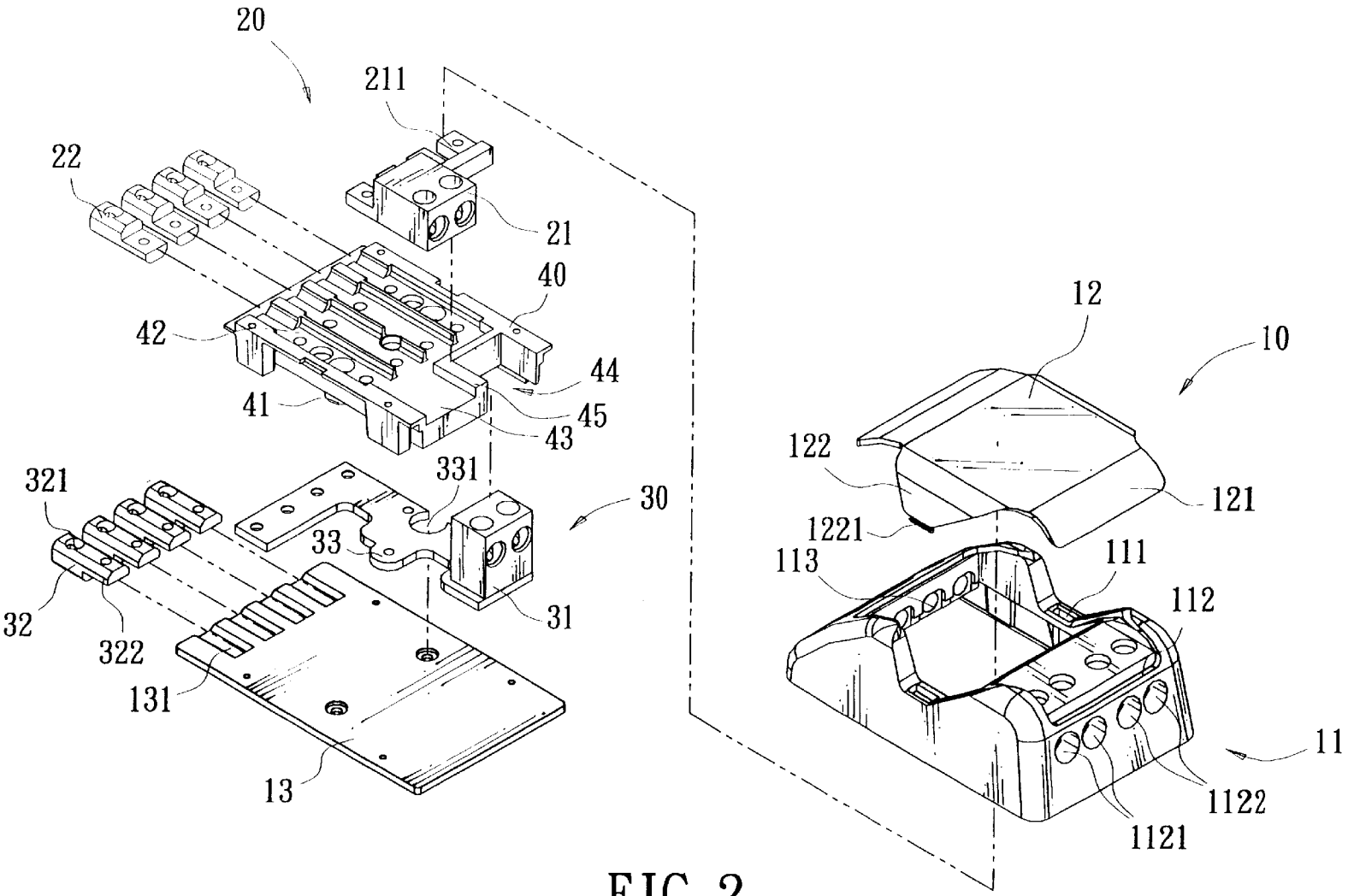
FIG. 2 is an exploded view of a preferred embodiment of distributor of motor vehicle according to the invention.
Figure 3:
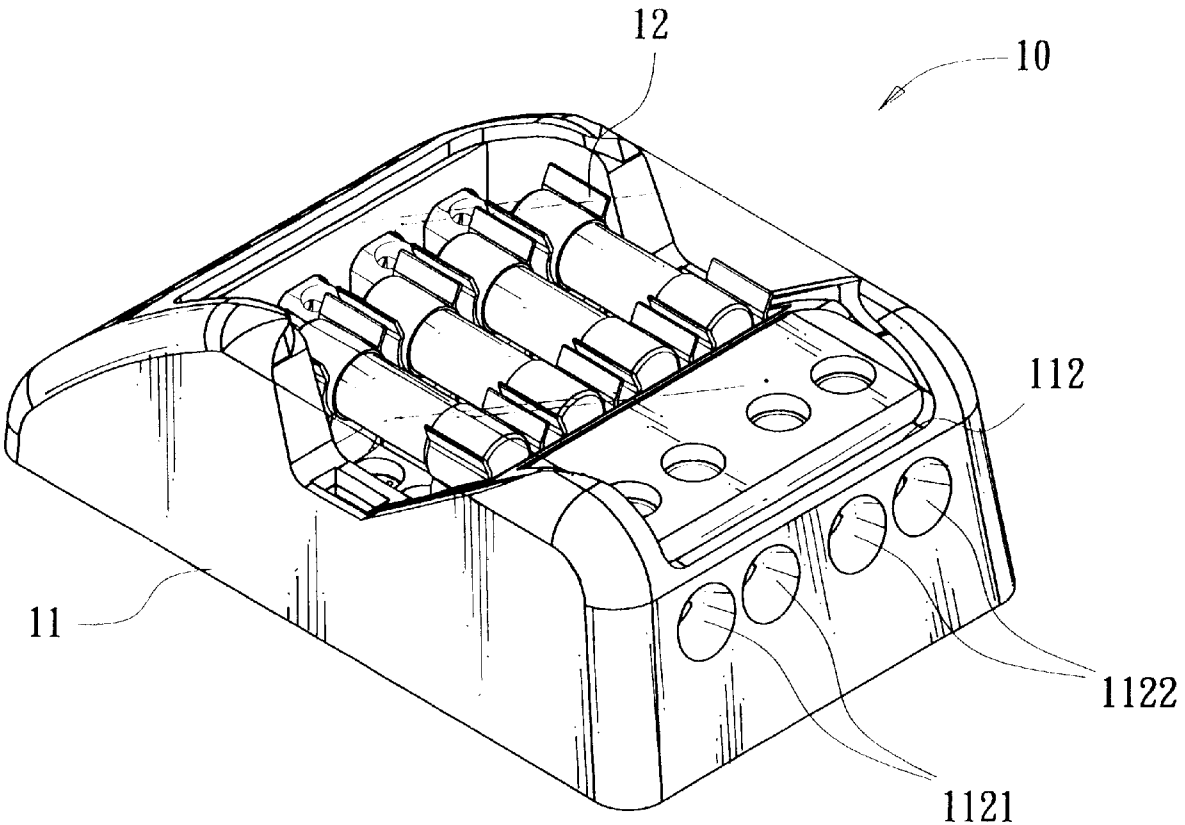
FIG. 3 is a perspective view of the preferred embodiment.
Figure 4:
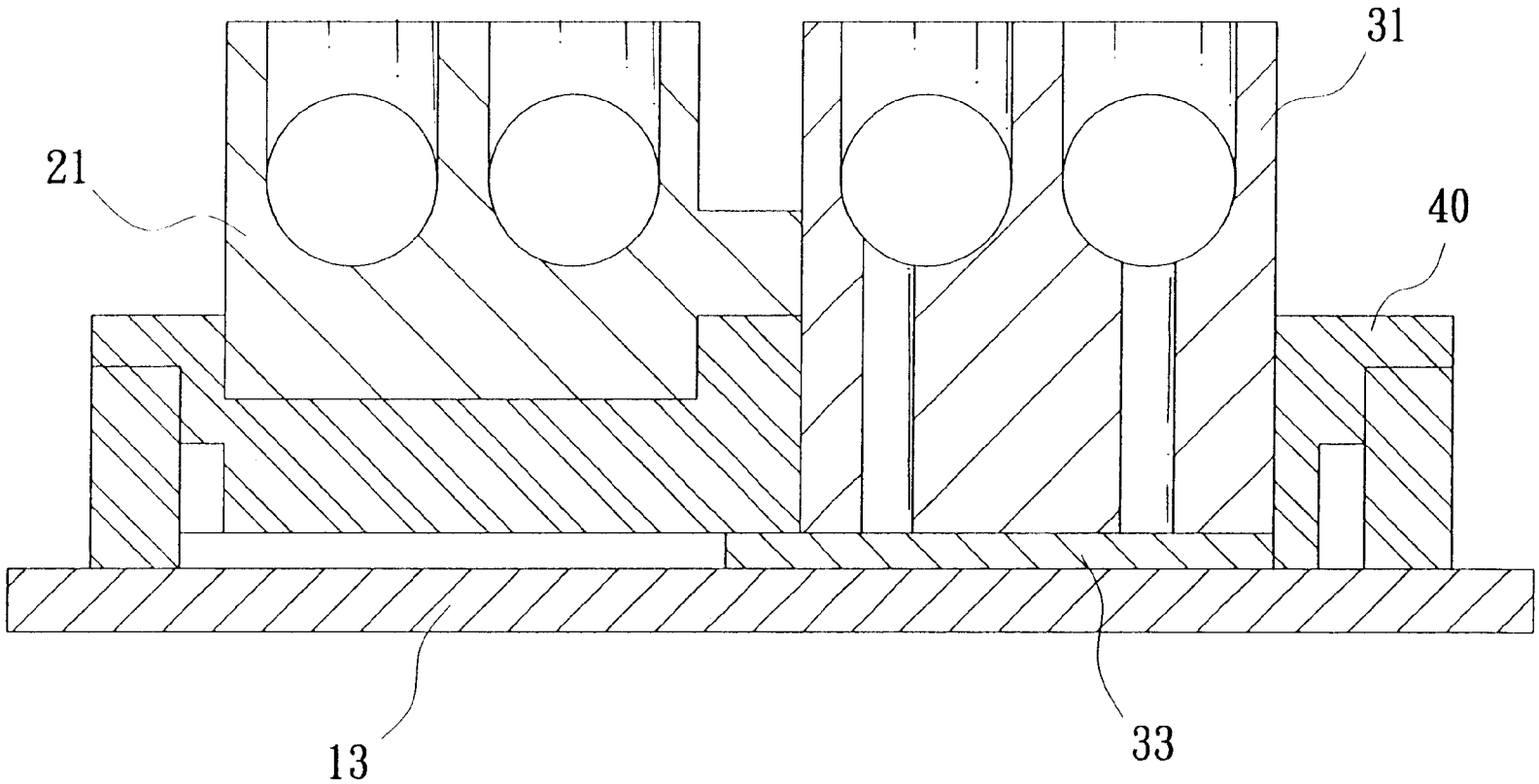
FIG. 4 is a cross-sectional view of the preferred embodiment.

Referring to FIGS. 2, 3, and 4, there is shown a distributor of motor vehicle constructed in accordance with the invention comprising a housing member 10, a fuse block 20, a negative current distributing member 30, and a divider 40.

Housing member 10 comprises a frame 11 and a cover 12. The cover 12 has a pivot member 12 on a first side, a member with nonslip slits on the second side opposite to the pivot member 121, and two opposed plate members 122 on third and fourth sides respectively. Each plate member 122 has a front tab 1221. The frame 11 has a space open to the top and bottom for receiving the transparent cover 12 on the top, a pivot side 112 matingly engaged with pivot member 121 of cover 12, two recesses 111 on two opposed sides matingly secured to tabs 1221 such that a press on plate members 122 may lift cover 12, and a base 13 mounted in the bottom of frame 11. Fuse block 20, negative current distributing member 30, and divider 40 are received in the internal space of frame 11.

A plurality of positive input terminal slots 1121 and a plurality of negative input terminal slots 1122 are provided on the pivot side 112. An L-shaped channel (not shown) is formed in the frame 11 for insulating positive current from negative current in the distributor. A recess 44 is formed on divider 40 for receiving negative input terminal block 31. A groove 43 is adjacent recess 44 for receiving positive input terminal block 21. A plurality of positive output terminal slots 113 and a plurality of negative output terminal slots (not shown) are provided on the end of frame 11 opposed to the pivot side 112. A plurality of recesses (not shown) formed in frame 11 and a plurality of recesses 131 formed in the base 13 are communicating for receiving a plurality of cord terminals 321 of negative output terminals 32 of negative current distributing member 30. The components are enclosed in frame 11 with cover 12 covered on frame 11 for preventing dust and foreign objects from entering the distributor.

Fuse block 20 comprises a positive input terminal block 21 and a plurality of positive output terminals 22. Negative current distributing member 30 comprises a negative input terminal block 31, a plurality of negative output terminals 32, and a metal plate 33 (e.g., made of copper). The metal plate 33 is integrally formed with (or clung to) negative input terminal block 31 on one end and integrally formed with (or clung to) distributor terminals 322 of negative output terminals 32 on the other end. The distributor terminals 322 are received in a plurality of troughs that are formed by a divider 40 and metal plate 33 (not shown). Metal plate 33 further has arcuate recess 331 for allowing studs 41 on the bottom of divider 40 to pass through. Therefore metal plate 33 can be mounted on base 13.

Divider 40 can insulate positive current from negative current in the distributor. Divider 40 comprises a plurality of parallel elongate slots 42 having one end engaged with positive output terminals 22 and the other end engaged with a plurality of positive input terminals 211 of positive input terminal block 21. A plurality of fuses that is provided on the spaces on slots 42 is connected between positive output terminals 22 and positive input terminals 211 (see FIGS. 2 and 3). A riser 45 is formed between positive input terminal block 21 and negative input terminal block 31 for insulating positive input terminal block 21 from negative input terminal block 31 as well as reducing storage space of blocks 21 and 31 (see FIG. 4). A plurality of recesses (not shown) is formed on the bottom of divider 40 for receiving the raised portions of distributor terminals 322 of negative output terminals 32.

The benefits of this invention include compactness, convenience in installation, and reduction in the manufacturing cost by using one mold to manufacture the distributor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A distributor for a motor vehicle comprising:

a housing member having a plurality of positive input terminal slots, a plurality of negative input slots, a plurality of positive output terminal slots, and a plurality of negative output terminal slots;

a fuse block inside the housing member, the fuse block having a positive input terminal block with a plurality of positive input terminals on one end and a plurality of positive output terminals on the other end;

a negative current distributing member inside the housing member, the negative current distributing member having a negative input terminal block, a plurality of negative output terminals, and a metal plate engaged with the negative input terminal block on one end and the plurality of negative output terminals on the other end; and a divider inside the housing member, the divider insulating positive current from negative current in the distributor, the divider having a recess for receiving the negative input terminal block and a groove near the recess but without contacting for the receiving positive input terminal block.

2. The distributor of claim 1, where the metal plate, the negative input terminal block, and the negative output terminals are clung together.

3. The distributor of claim 1, wherein housing member has a top and a bottom and wherein the divider is located between the fuse block and the negative current distributing member, the fuse block being located above the negative current distributing member and being closer to the top of the housing member.

4. The distributor of claim 1, wherein the divider includes a plurality or elongated slots for receiving a plurality of fuses, the positive input terminals being paired with the positive output terminals, the negative input terminals being paired with the negative output terminals, and a slot for a fuse being provided between each of the pairs of positive input terminals and positive output terminals and between each of the pairs of negative input terminals and negative output terminals.

5. The distributor of claim 4, wherein at least two positive input terminals, at least two positive output terminals, at least two negative input terminals, at least two negative output terminals and at least four elongated slots in the divider are provided.

6. The distributor of claim 1, wherein the housing member has opposed front and rear sides and opposed top and bottom sides and wherein the positive input terminals and the negative input terminals are positioned at the front side of the housing member and wherein the positive output terminals and the negative output terminals are positioned at the rear side of the housing member.

7. The distributor of claim 6, wherein the metal plate of the negative current distributing member is located closer to the bottom side of the housing member than the divider and wherein the fuse block is located closer to the top side of the housing member than the divider and wherein the positive input terminals and the negative input terminals are longitudinally aligned.

8. The distributor of claim 1, wherein the metal plate of the negative current distributing member is located closer to a bottom side of the housing member than the divider and wherein the fuse block is located closer to a top side of the housing member than the divider.

9. The distributor of claim 1, wherein the positive input terminals and the negative input terminals are longitudinally aligned on a front side of the housing member, the positive output terminals and negative output terminals being on a rear side of the housing member, the front side of the housing member being opposed to the rear side of the housing member.

10. The distributor of claim 1, wherein the housing member further comprises:

a cover;

a base; and a frame, having a space open to the top and the bottom for receiving the cover on the top and the base on the bottom.

11. The distributor of claim 10, wherein the frame has a channel on one end and a plurality of recesses on the other end.

12. The distributor of claim 10, wherein the cover has a member with non-slip slits on a side there of.

13. The distributor of claim 10, wherein the cover is made of a transparent material.

14. The distributor of claim 10, wherein the cover further has two front tabs which are engagable with two recessed members on opposed sides of the frame to matingly secure the cover to the frame.

15. The distributor of claim 10, wherein the base comprises a plurality of recesses on one end.

16. The distributor of claim 1, wherein the divider further comprises a plurality of parallel elongated slots in one end and at least one stud projected down from the bottom.

17. The distributor of claim 1, where the metal plate is made of copper.

18. The distributor of claim 1, wherein the metal plate, the negative input terminal block, and the negative output terminals are integrally formed together.

* * * * *